US011052290B2

(12) United States Patent
Sajima et al.

(10) Patent No.: US 11,052,290 B2
(45) **Date of Patent: *Jul. 6, 2021**

(54) GOLF BALL

(71) Applicant: SUMITOMO RUBBER INDUSTRIES, LTD., Kobe (JP)

(72) Inventors: Takahiro Sajima, Kobe (JP); Toshiyuki Takubo, Kobe (JP)

(73) Assignee: SUMITOMO RUBBER INDUSTRIES, LTD., Kobe (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/785,222

(22) Filed: Feb. 7, 2020

(65) Prior Publication Data

US 2020/0269095 A1 Aug. 27, 2020

(30) Foreign Application Priority Data

Feb. 22, 2019 (JP) ..... JP2019-030326

(51) Int. Cl.
*A63B 37/06* (2006.01)
*A63B 37/00* (2006.01)

(52) U.S. Cl.
CPC ..... *A63B 37/0022* (2013.01); *A63B 37/0004* (2013.01)

(58) Field of Classification Search
CPC ..... A63B 37/0005; A63B 37/0004
USPC ..... 473/378
See application file for complete search history.

(56) References Cited

U.S. PATENT DOCUMENTS

| | | | | |
|---|---|---|---|---|
| 5,916,044 | A * | 6/1999 | Shimosaka | A63B 37/0004 473/377 |
| 6,179,731 | B1 * | 1/2001 | Shimosaka | A63B 37/0004 473/378 |
| 2002/0094886 | A1 * | 7/2002 | Sajima | A63B 37/0004 473/378 |
| 2005/0037871 | A1 * | 2/2005 | Nardacci | A63B 37/0021 473/378 |
| 2011/0077106 | A1 | 3/2011 | Fitchett | |
| 2015/0182805 | A1 | 7/2015 | Sajima et al. | |
| 2015/0375058 | A1 * | 12/2015 | Kamino | A63B 37/0077 473/374 |
| 2016/0067552 | A1 * | 3/2016 | Hixenbaugh | A63B 37/0089 473/383 |

(Continued)

FOREIGN PATENT DOCUMENTS

| | | |
|---|---|---|
| JP | 2-68077 A | 3/1990 |
| JP | 2011-72776 A | 4/2011 |
| JP | 2014-520654 A | 8/2014 |

(Continued)

*Primary Examiner* — Raeann Gorden
(74) *Attorney, Agent, or Firm* — Birch, Stewart, Kolasch & Birch, LLP

(57) ABSTRACT

A golf ball has a plurality of minute projections 20 on a surface thereof. An average value Hav of heights H of these minute projections 20 is not less than 0.5 μm and not greater than 50 μm. The surface of the golf ball has one or more first zones and one or more second zones. An average value Hav1 of the heights H of the minute projections 20 on these first zones is higher than an average value Hav2 of the heights H of the minute projections 20 on these second zones. Preferably, the average value Hav1 and the average value Hav2 satisfy the following mathematical formula.

$$3 \leq (Hav1 - Hav2) \leq 50$$

11 Claims, 12 Drawing Sheets

(56) References Cited

U.S. PATENT DOCUMENTS

2018/0093137 A1* 4/2018 Park ..... C09D 175/06

FOREIGN PATENT DOCUMENTS

JP 2015-142599 A 8/2015
WO WO 2013/012796 A2 1/2013

* cited by examiner

GOLF BALL

CROSS-REFERENCE TO RELATED APPLICATION

This application claims priority on and the benefit of Patent Application No. 2019-30326 filed in JAPAN on Feb. 22, 2019. The entire disclosures of this Japanese Patent Application are hereby incorporated by reference.

BACKGROUND OF THE INVENTION

Field of the Invention

The present invention relates to golf balls. Specifically, the present invention relates to golf balls each having a paint layer on the surface thereof.

Description of the Related Art

Golf balls have a large number of dimples on the surfaces thereof. The dimples disturb the air flow around the golf ball during flight to cause turbulent flow separation. This phenomenon is referred to as "turbulization". Due to turbulization, separation points of the air from the golf ball shift backwards leading to a reduction of drag. The turbulization promotes the displacement between the separation point on the upper side and the separation point on the lower side of the golf ball, which results from the backspin, thereby enhancing the lift force that acts upon the golf ball. The reduction of drag and the enhancement of lift force are referred to as a "dimple effect". Excellent dimples efficiently disturb the air flow. Excellent dimples produce a long flight distance.

A flight distance of a golf ball is the total of a carry and a run. The carry is the distance from the launch point to the landing point. The run is the distance from the landing point to the stopping point. Upon a shot with a short iron, a large carry and a small run are desired. This is because golf players place importance on causing a golf ball to stop at a target point upon a shot with a short iron. Meanwhile, upon a shot with a driver, a large carry and a large run are desired. This is because golf players desire to make a golf ball as close to the pin as possible upon a shot with a driver. Regarding second shots and the like in par-five holes, a large carry and a large run may be desired even upon shots with a long iron and a middle iron.

The depths of dimples influence the aerodynamic characteristics of a golf ball. Deep dimples reduce the lift force that acts upon a golf ball. A trajectory of a golf ball having deep dimples is low. Therefore, with this golf ball, a large run is obtained. However, a carry of this golf ball is not sufficient. There is room for improvement in the flight distance (total) of this golf ball.

JP2015-142599 discloses a golf ball having a surface with large roughness. The roughness can be formed by blasting or the like. The roughness enhances the aerodynamic characteristics of the golf ball due to a synergetic effect with dimples.

JP2011-72776 discloses a golf ball having a coating formed from a paint that contains particles. The particles enhance the aerodynamic characteristics of the golf ball due to a synergetic effect with dimples.

JPH2-68077 discloses a golf ball having dimples each having one projection at a bottom thereof. The dimples each having the projection enhance the aerodynamic characteristics of the golf ball.

JP2014-520654 discloses a golf ball including a coating with a micro surface roughness. The surface of the golf ball has a zone having a high roughness and a zone having a low roughness. The coating enhances the aerodynamic characteristics of the golf ball.

The greatest interest to golf players concerning golf balls is flight distance. Golf players desire golf balls having excellent flight performance. Golf players desire large flight distances (total) upon shots with a driver, a long iron, and a middle iron. For flight distances upon shots with middle irons, conventional studies are insufficient.

A golf ball has a main body and a paint layer. When the golf ball is hit with a golf club, the golf ball collides against the clubface of the golf club. When a golf ball falls, the golf ball collides against the ground. Due to these collisions, the paint may be peeled from the main body. This peeling impairs the appearance of the golf ball.

An object of the present invention is to provide a golf ball having excellent flight performance upon a shot with a middle iron. Another object of the present invention is to provide a golf ball having a paint layer that is less likely to be peeled.

SUMMARY OF THE INVENTION

A golf ball according to the present invention has a main body and a paint layer positioned outside the main body. The golf ball has, on a surface thereof, a plurality of minute projections having a shape in which a surface shape of the main body is reflected. An average value Hav of heights H of the minute projections is not less than 0.5 μm and not greater than 50 μm. The surface of the golf ball has one or more first zones and one or more second zones. An average value Hav1 of the heights H of the minute projections on the first zones is higher than an average value Hav2 of the heights H of the minute projections on the second zones.

With the golf ball according to the present invention, the minute projections reduce the lift force of the golf ball during flight. A trajectory of the golf ball is not excessively high. Furthermore, with the golf ball, coexistence of the first zones and the second zones reduce drag. Therefore, with the golf ball, a large flight distance is obtained upon a shot with a middle iron.

The golf ball has a plurality of minute projections having a shape in which the surface shape of the main body is reflected. In other words, the main body has projection portions that cause the minute projections. Therefore, the main body and the paint layer are in contact with each other with a large area. The projection portions further serve as anchors to the paint layer. The paint layer is less likely to be peeled from the main body.

Preferably, a ratio S1 of a total area of the first zones to a surface area of a phantom sphere of the golf ball and a ratio S2 of a total area of the second zones to the surface area of the phantom sphere of the golf ball satisfy the following mathematical formula.

$$1 \leq (S1/S2) \leq 19$$

Preferably, the average value Hav1 and the average value Hav2 satisfy the following mathematical formula.

$$3 \leq (Hav1 - Hav2) \leq 50$$

Preferably, an arithmetic average height Sa1 of each first zone is larger than an arithmetic average height Sa2 of any second zone. Preferably, a maximum height Sz1 of each first zone is larger than a maximum height Sz2 of any second zone.

Preferably, the paint layer has a thickness of not less than 5 μm and not greater than 30 μm. Preferably, the paint layer contains a base polymer and particles dispersed in the base polymer. The particles have an average particle diameter of not less than 1 μm and not greater than 15 μm.

A golf ball production method according to the present invention includes the steps of:

introducing a material of a cover into a mold having a plurality of minute recesses on a cavity face thereof;

forming the cover having minute projection portions having a shape that is an inverted shape of the minute recesses, from the material; and applying a paint to a surface of the cover to form a plurality of minute projections having a shape in which a surface shape of the cover is reflected.

A golf ball having a main body and a paint layer positioned outside the main body can be produced by the production method. The golf ball has, on a surface thereof, a plurality of minute projections having a shape in which a surface shape of the main body is reflected. An average value Hav of heights H of the minute projections is not less than 0.5 μm and not greater than 50 μm. The surface of the golf ball has one or more first zones and one or more second zones. An average value Hav1 of the heights H of the minute projections on the first zones is higher than an average value Hav2 of the heights H of the minute projections on the second zones.

DESCRIPTION OF THE PREFERRED EMBODIMENTS

The following will describe in detail the present invention based on preferred embodiments with appropriate reference to the drawings.

Figure 1:
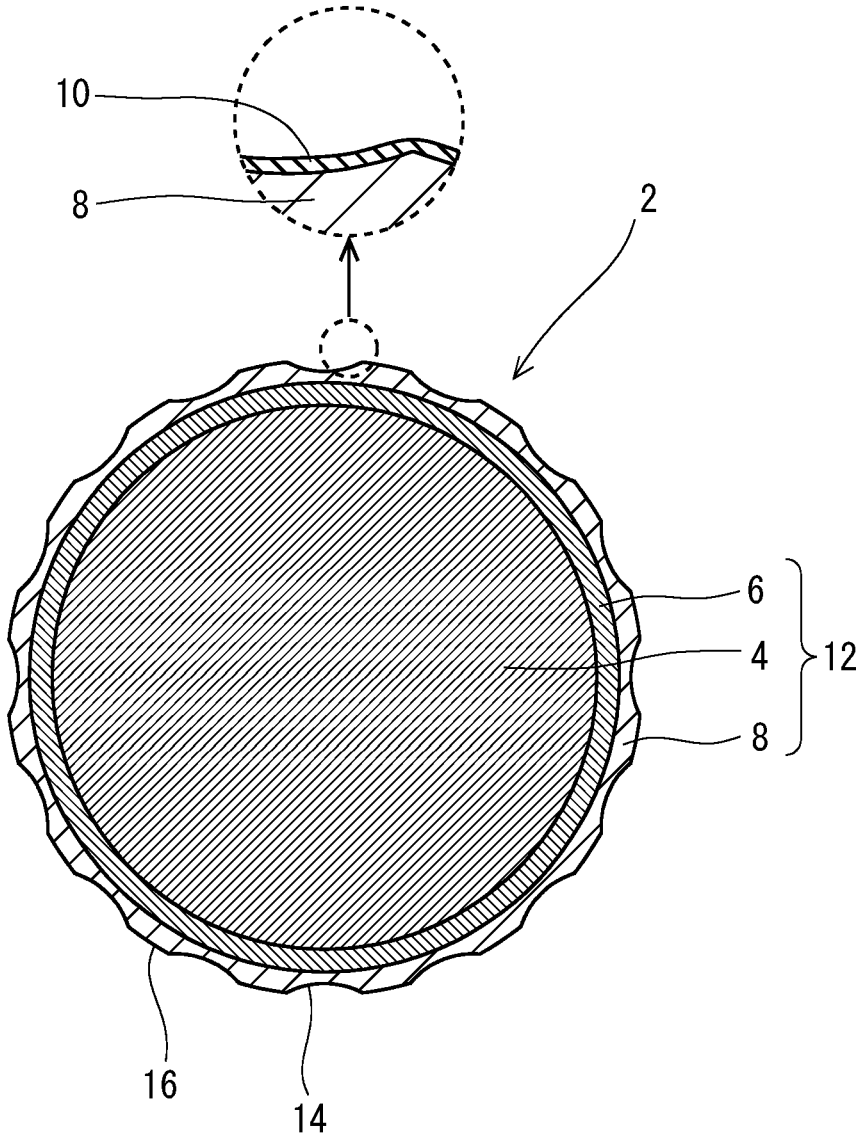
FIG. 1 is a cross-sectional view of a golf ball according to an embodiment of the present invention.

A golf ball 2 shown in FIG. 1 includes a spherical core 4, a mid layer 6 positioned outside the core 4, a cover 8 positioned outside the mid layer 6, and a paint layer 10 positioned outside the cover 8. The core 4, the mid layer 6, and the cover 8 are included in a main body 12 of the golf ball 2. The golf ball 2 has a large number of dimples 14 on the surface thereof. Of the surface of the golf ball 2, a part other than the dimples 14 is a land 16. The main body 12 may have a one-piece structure, a two-piece structure, a four-piece structure, a five-piece structure, or the like.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The diameter of the golf ball 2 according to the present embodiment is 42.7 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

Preferably, the core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The core 4 may be formed from a resin composition. The core 4 may be formed from a mixture of a rubber composition and a resin composition. A resin composition that will be described later for the mid layer 6 or the cover 8 can be used for the core 4.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ions, potassium ions, lithium ions, zinc ions, calcium ions, magnesium ions, aluminum ions, and neodymium ions.

Instead of an ionomer resin or together with an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a thermoplastic resin composition, a thermosetting resin composition, or a mixture of both compositions. Preferably, the cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 having the cover 8 that includes an ionomer resin has excellent resilience performance. The golf ball 2 has excellent flight distance upon a shot with a driver. The ionomer resin described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the cover 8 may include a pigment. The resin composition can include an inorganic pigment and an organic pigment. Examples of the inorganic pigment include: red pigments such as iron oxide red ($Fe_2O_3$), red lead ($Pb_3O_4$), molybdenum red, and cadmium red; yellow pigments such as titanium yellow ($TiO_2$—$NiO$—$Sb_2O_3$), litharge ($PbO$), chrome yellow ($PbCrO_4$), yellow iron oxide ($FeO(OH)$), and cadmium yellow; and blue pigments such as cobalt blue ($CoO.Al_2O_3$), Prussian blue, and ultramarine blue. Examples of the organic pigment include azo pigments, phthalocyanine pigments, and perylene pigments. Azo pigments are preferable. Examples of azo pigments include pigment yellow 1, pigment yellow 12, pigment red 3, pigment red 57, and pigment orange 13.

The resin composition of the cover 8 may include a filler, a dispersant, an antioxidant, an ultraviolet absorber, a light stabilizer, a fluorescent material, a fluorescent brightener, and the like in an adequate amount.

The cover 8 has a thickness of preferably not less than 0.2 mm and particularly preferably not less than 0.3 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05. The cover 8 may have two or more layers.

Figure 2:
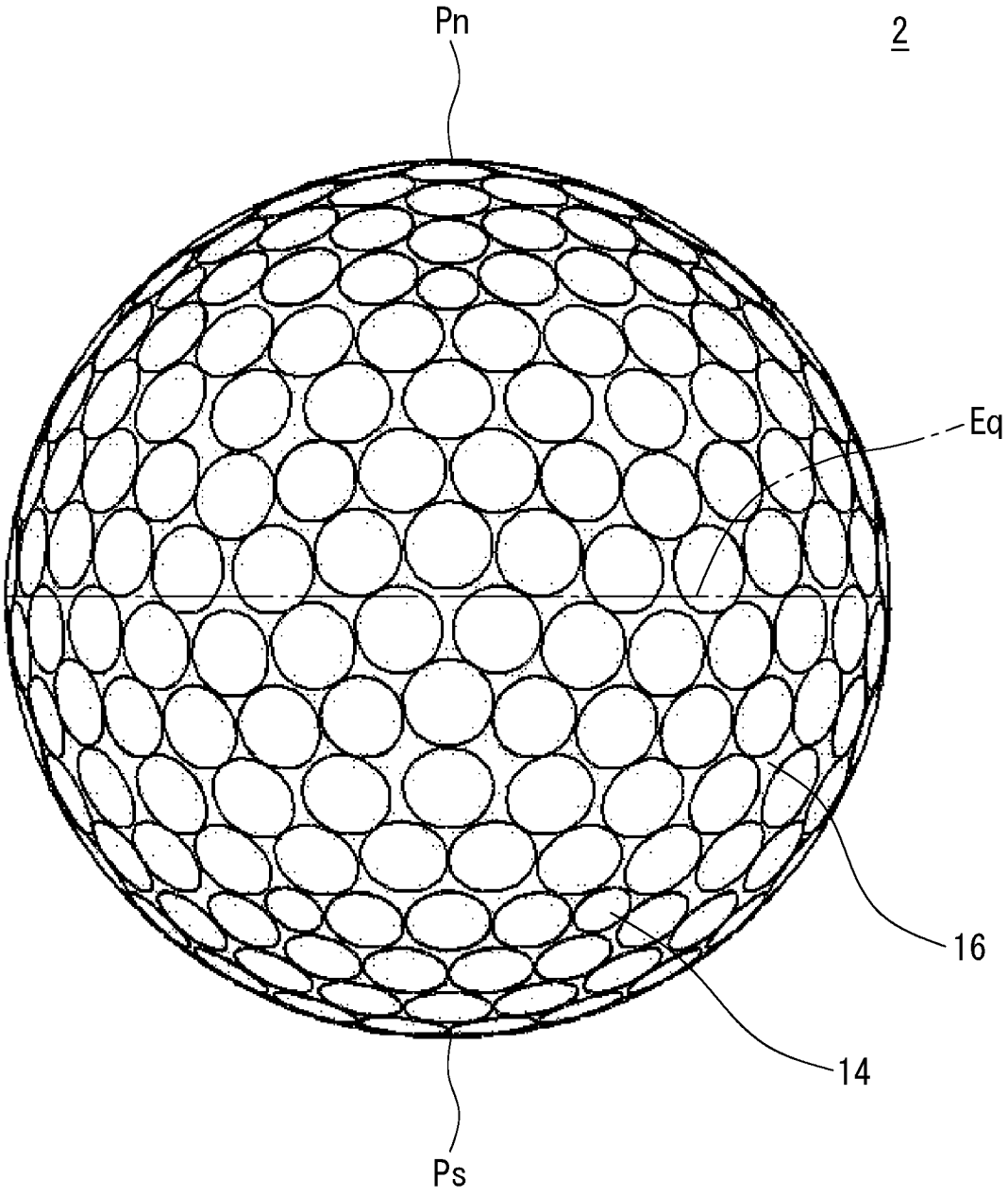
FIG. 2 is an enlarged front view of the golf ball in FIG. 1.
Figure 3:
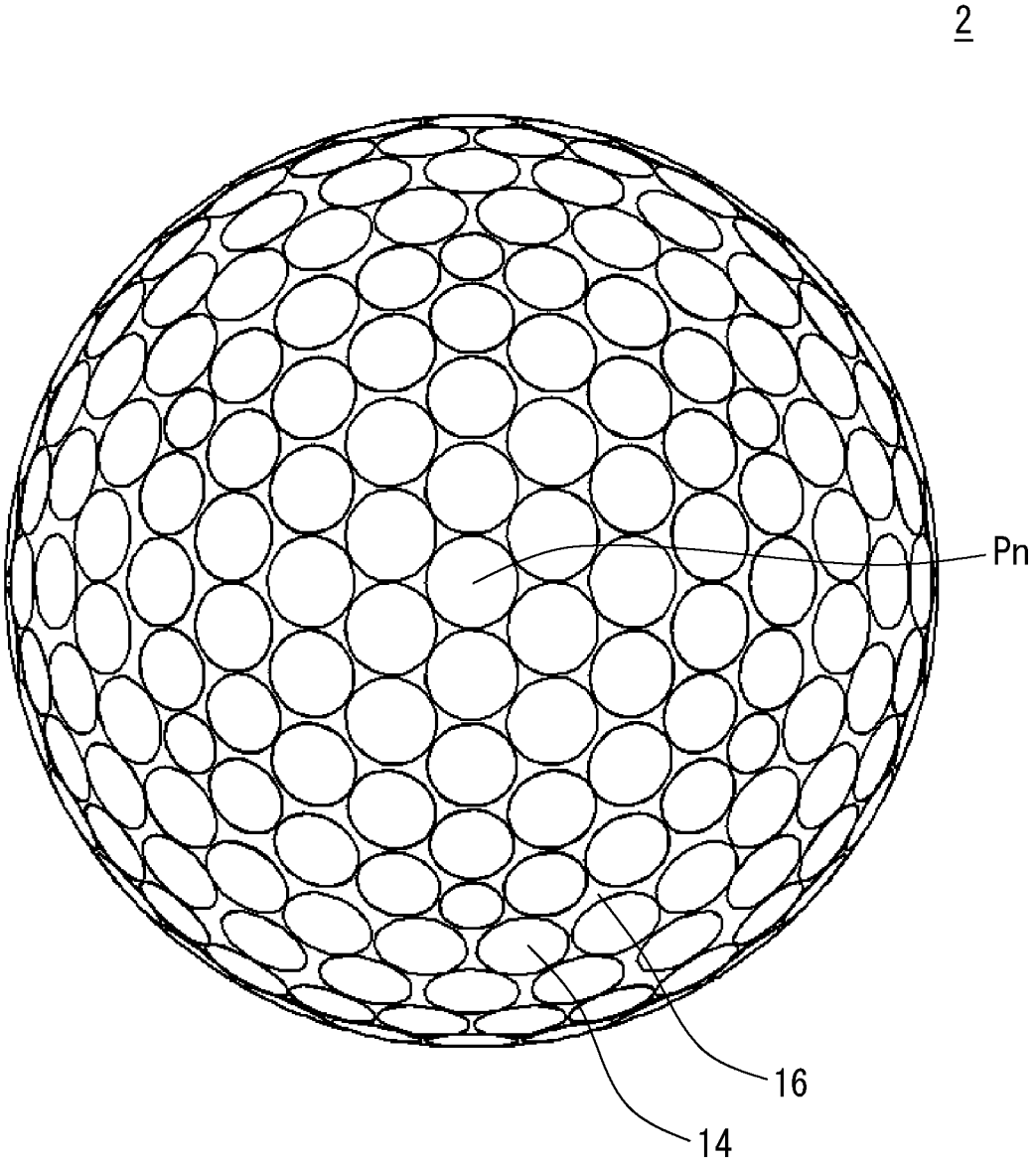
FIG. 3 is a plan view of the golf ball in FIG. 2.

FIG. 2 is an enlarged front view of the golf ball 2 in FIG. 1, and FIG. 3 is a plan view of the golf ball 2. As described above, the golf ball 2 has a large number of the dimples 14 on the surface thereof. The contour of each dimple 14 is circular. The golf ball 2 has a plurality of types of the dimples 14 having different diameters. The total number of the dimples 14 is 338. The golf ball 2 may have non-circular dimples instead of the circular dimples 14 or together with circular dimples 14. In FIG. 2, reference character Eq indicates an equator, reference character Pn indicates a north pole, and reference character Ps indicates a south pole.

Figure 4:
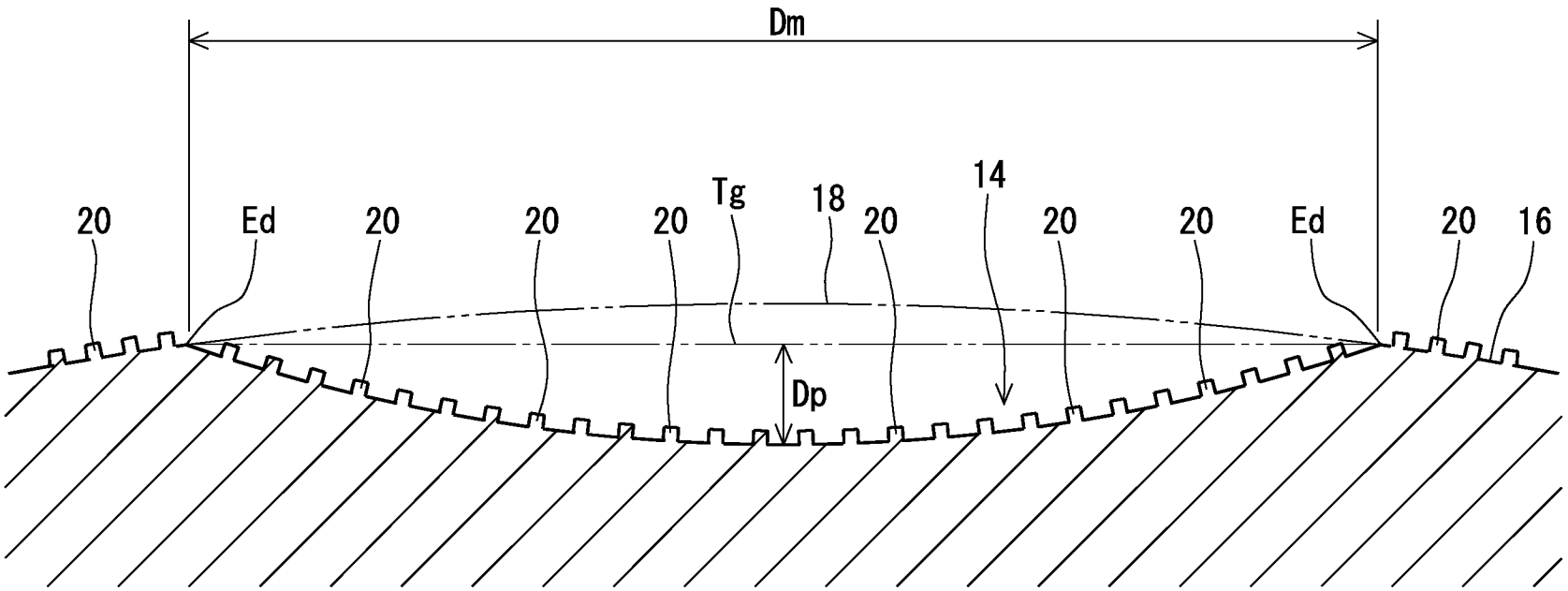
FIG. 4 is a partially enlarged cross-sectional view of the golf ball in FIG. 1.

FIG. 4 shows a cross section of the golf ball 2 along a plane passing through the central point of a dimple 14 and the central point of the golf ball 2. In FIG. 4, the top-to-bottom direction is the depth direction of the dimple 14. In FIG. 4, an alternate long and two short dashes line 18 indicates a phantom sphere. The surface of the phantom sphere 18 is the surface of the golf ball 2 when it is postulated that no dimple 14 and no minute projection 20 (described in detail later) exist. The diameter of the phantom sphere 18 is equal to the diameter of the golf ball 2. The dimple 14 is recessed from the surface of the phantom sphere 18. The land 16 coincides with the surface of the phantom sphere 18.

In FIG. 4, an arrow Dm indicates the diameter of the dimple 14. The diameter Dm is the distance between two tangent points Ed appearing on a tangent line Tg that is drawn tangent to the far opposite ends of the dimple 14. Each tangent point Ed is also the edge of the dimple 14. The edge Ed defines the contour of the dimple 14.

The diameter Dm of each dimple 14 is preferably not less than 2.0 mm and not greater than 6.0 mm. The dimple 14 having a diameter Dm of not less than 2.0 mm contributes to turbulization. From this viewpoint, the diameter Dm is more preferably not less than 2.5 mm and particularly preferably not less than 2.8 mm. The dimple 14 having a diameter Dm of not greater than 6.0 mm does not impair a fundamental feature of the golf ball 2 being substantially a sphere. From this viewpoint, the diameter Dm is more preferably not greater than 5.5 mm and particularly preferably not greater than 5.0 mm.

In the case of a non-circular dimple, a circular dimple 14 having the same area as that of the non-circular dimple is assumed. The diameter of the assumed dimple 14 can be regarded as the diameter of the non-circular dimple.

In FIG. 4, a double ended arrow Dp indicates the depth of the dimple 14. The depth Dp is the distance between the deepest part of the dimple 14 and the tangent line Tg. An average depth Dpav is calculated by summing the depths Dp of all the dimples 14 and dividing the sum of the depths Dp by the total number of the dimples 14. The average depth Dpav is preferably not less than 80 μm and not greater than 200 μm. With the golf ball 2 in which the average depth Dpav is not less than 80 μm, a large run can be achieved. From this viewpoint, the average depth Dpav is more preferably not less than 100 μm and particularly preferably not less than 110 μm. With the golf ball 2 in which the average depth Dpav is not greater than 200 μm, a large carry can be achieved. From this viewpoint, the average depth Dpav is more preferably not greater than 180 μm and particularly preferably not greater than 160 μm.

The area S of the dimple 14 is the area of a region surrounded by the contour line of the dimple 14 when the central point of the golf ball 2 is viewed at infinity. In the case of a circular dimple 14, the area S is calculated by the following mathematical formula.

$$S=(Dm/2)^2*n$$

From the viewpoint of achieving a sufficient total area of the dimples 14, the total number N of the dimples 14 is preferably not less than 250, more preferably not less than 280, and particularly preferably not less than 300. From the viewpoint that each dimple 14 can contribute to turbulization, the total number N is preferably not greater than 500, more preferably not greater than 450, and particularly preferably not greater than 400.

In the present invention, the "volume of the dimple" means the volume of a portion surrounded by the surface of the dimple 14 and the plane including the contour of the dimple 14. From the viewpoint that a large run can be achieved, the total volume of the dimples 14 is preferably not less than 240 $mm^3$, more preferably not less than 260 $mm^3$, and particularly preferably not less than 270 $mm^3$. From the viewpoint that a large carry can be achieved, the total volume is preferably not greater than 400 $mm^3$, more preferably not greater than 360 $mm^3$, and particularly preferably not greater than 330 $mm^3$.

Figure 5:
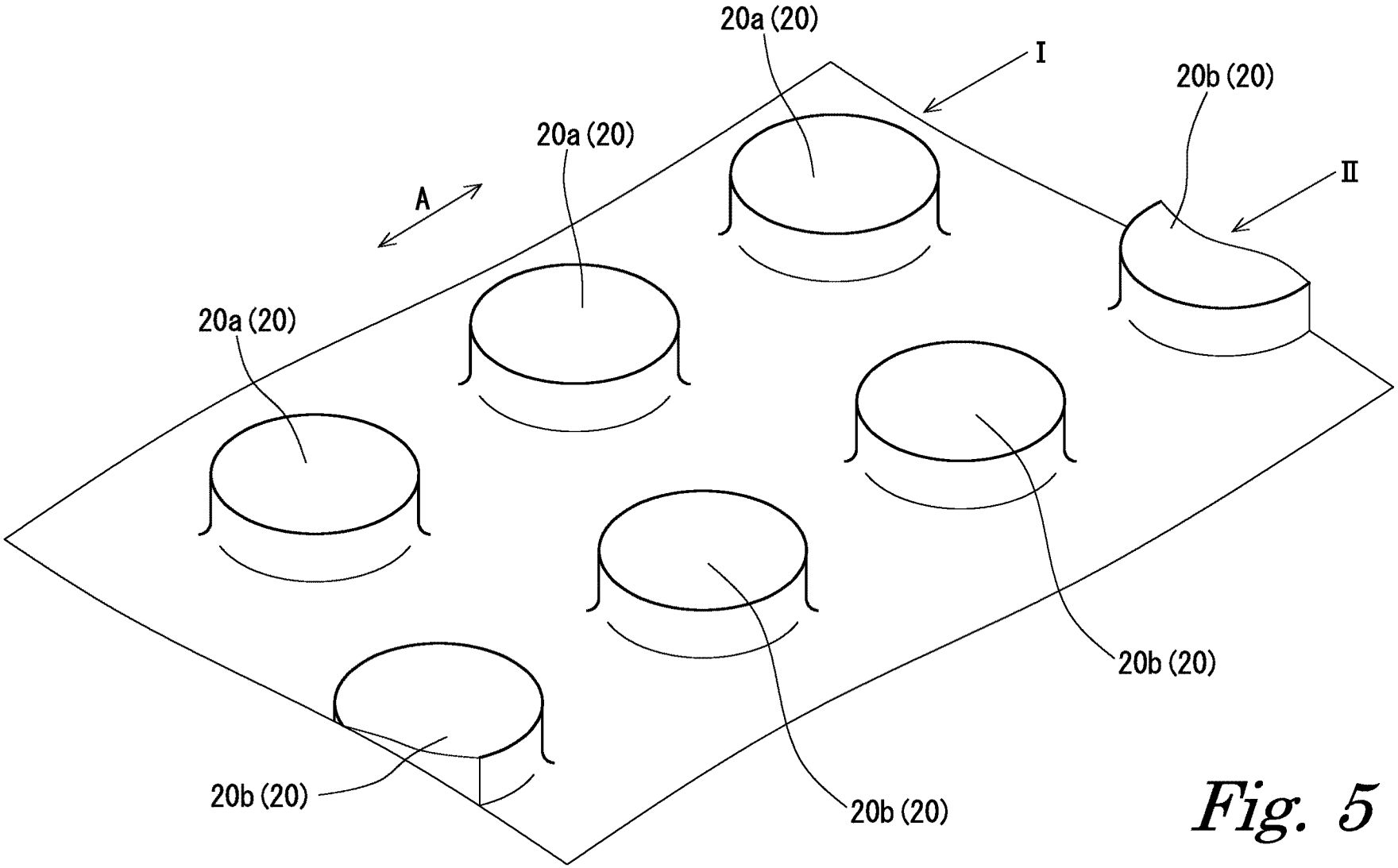
FIG. 5 is a partially enlarged perspective view of the surface of the golf ball in FIG. 1.

FIG. 5 is a partially enlarged perspective view of the surface of the golf ball 2 in FIG. 1. As shown in FIG. 5, the golf ball 2 has a large number of minute projections 20 on the surface thereof. Each minute projection 20 generally has a cylindrical shape. As is obvious from FIG. 4, the minute projections 20 are formed on the surfaces of the dimples 14 and also on the surface of the land 16. Each minute projection 20 stands outward in the radial direction of the golf ball 2. The minute projections 20 may be formed only on the surfaces of the dimples 14. The minute projections 20 may be formed only on the surface of the land 16.

The minute projections 20 reduce the lift force and the drag of the golf ball 2 during flight. Owing to the reduction of lift force, a large run can be achieved. Owing to the reduction of drag, a large carry can be achieved. The golf ball 2 has excellent flight performance upon a shot with a middle iron.

FIG. 5 shows a plurality of minute projections 20*a* belonging to a first row I, and a plurality of minute projections 20*b* belonging to a second row II. The direction indicated by an arrow A in FIG. 5 is the direction in which the rows extend. In each row, the minute projections 20 are aligned at equal pitches. In other words, the minute projections 20 are regularly aligned. The minute projections 20*a*, which belong to the first row I, and the minute projections 20*b*, which belong to the second row II, are arranged in a zigzag manner. At a part of the surface of the golf ball 2, the minute projections 20 may be irregularly aligned. The minute projections 20 may be irregularly aligned on the entirety of the surface of the golf ball 2.

Figure 6:
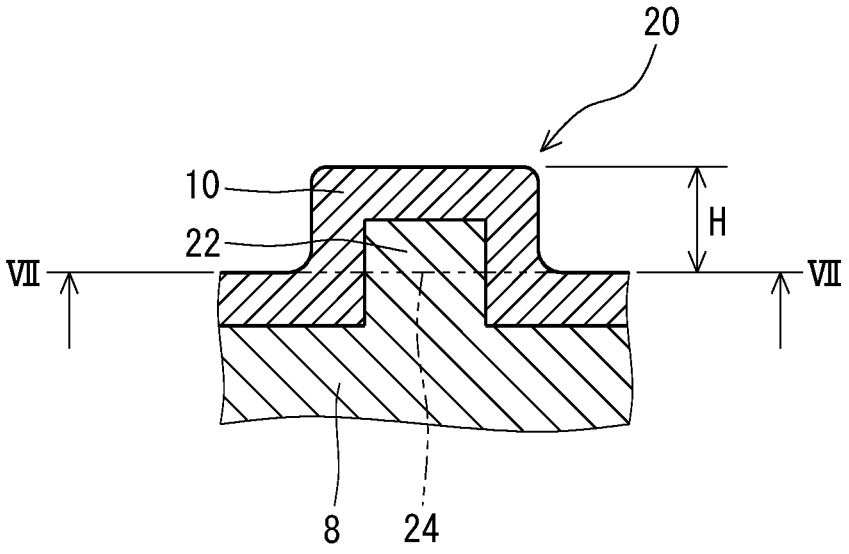
FIG. 6 is a partially enlarged cross-sectional view of the golf ball in FIG. 1.

FIG. 6 is a partially enlarged cross-sectional view of the golf ball 2 in FIG. 1. FIG. 6 shows the cover 8, which is a part of the main body 12, and the paint layer 10. FIG. 6 further shows the minute projection 20. The cover 8 has projection portions 22. The minute projection 20 is formed by the projection portion 22 and the paint layer 10. Each projection portion 22 is covered with the paint layer 10. The projection portion 22 stands outward in the radial direction of the golf ball 2 (upward in FIG. 6). Thus, the minute projection 20 also stands outward in the radial direction of the golf ball 2. In other words, the minute projection 20 has a shape in which the surface shape of the main body 12 (cover 8) is reflected. In FIG. 6, reference character 24 indicates the bottom surface of the minute projection 20.

Figure 7:
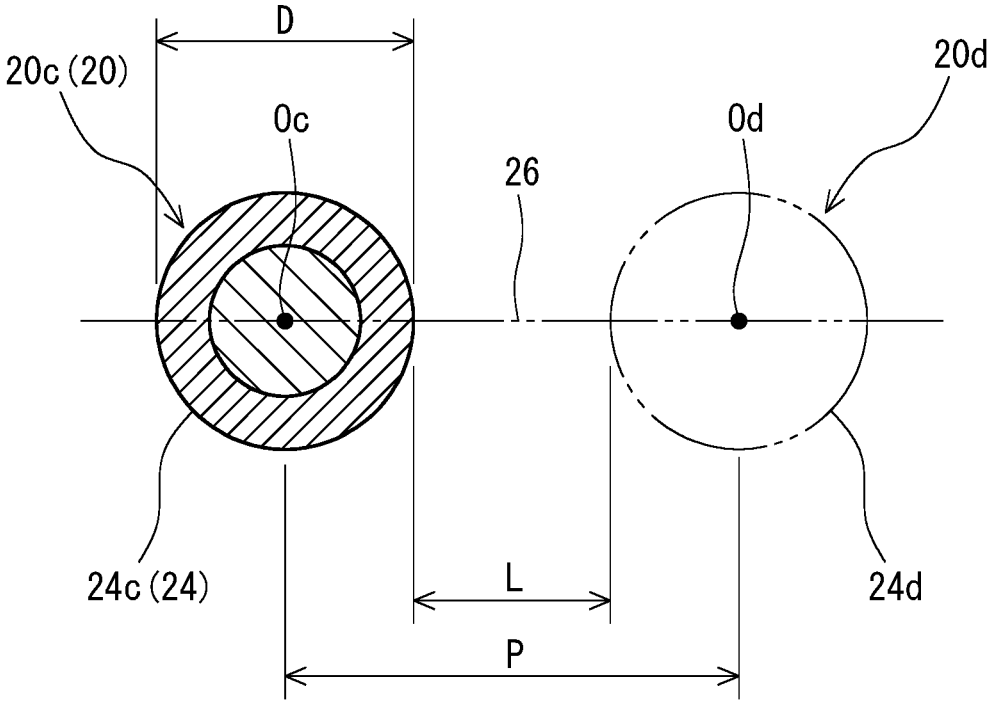
FIG. 7 is a cross-sectional view taken along a line VII-VII in FIG. 6.

FIG. 7 is a cross-sectional view taken along a line VII-VII in FIG. 6. FIG. 7 shows the bottom surface 24 of the minute projection 20. The bottom surface 24 includes the cover 8 and the paint layer 10. As described above, each minute projection 20 has a cylindrical shape. Therefore, the shape of the bottom surface 24 is a circle.

In FIG. 7, an arrow D indicates the diameter of the bottom surface 24 and also indicates the diameter of the minute projection 20. An average diameter Dav is calculated by summing the diameters D of all the minute projections 20 and dividing the sum of the diameters D by the number of the minute projections 20. The average diameter Dav is preferably not less than 5 μm and not greater than 50 μm. The golf ball 2 in which the average diameter Dav is in the above range has excellent flight distance upon a shot with a middle iron. With the golf ball 2 in which the average diameter Dav is in the above range, the paint layer 10 is less likely to be peeled. From these viewpoints, the average diameter Dav is more preferably not less than 15 μm and particularly preferably not less than 20 μm. In light of flight distance, the average diameter Dav is more preferably not greater than 40 μm and particularly preferably not greater than 35 μm.

The area of each minute projection 20 is defined as the area of the bottom surface 24. The area Sp of the minute projection 20 shown in FIGS. 6 and 7 can be calculated by the following mathematical formula.

$$Sp=(D/2)^2*n$$

The ratio Pp of the sum of the areas Sp of all the minute projections 20 to the surface area of the phantom sphere 18 of the golf ball 2 is preferably not less than 7%. The golf ball 2 in which the ratio Pp is not less than 7% has excellent flight distance upon a shot with a middle iron. With the golf ball 2 in which the ratio Pp is not less than 7%, the paint layer 10 is less likely to be peeled. From these viewpoints, the ratio Pp is preferably not less than 15% and particularly preferably not less than 20%. In light of ease of production of a mold for the golf ball 2, the ratio Pp is preferably not greater than 50%, more preferably not greater than 40%, and particularly preferably not greater than 35%.

FIG. 7 shows a bottom surface 24*c* of a first minute projection 20*c* and also shows a bottom surface 24*d* of a second minute projection 20*d* by an alternate long and two short dashes line. The second minute projection 20*d* is adjacent to the first minute projection 20*c*. In FIG. 7, an alternate long and two short dashes line 26 represents a straight line passing through the center of gravity Oc of the bottom surface 24*c* of the first minute projection 20*c* and the center of gravity Od of the bottom surface 24*d* of the second minute projection 20*d*.

In FIG. 7, an arrow P indicates a pitch. The pitch P is the distance between the first minute projection 20*c* and the second minute projection 20*d* adjacent to the first minute projection 20*c*. The pitch P is the distance between the center of gravity Oc of the bottom surface 24*c* of the first minute projection 20*c* and the center of gravity Od of the bottom surface 24*d* of the second minute projection 20*d*. The "second minute projection 20*d* adjacent to the first minute projection 20*c*" is the minute projection 20*d* having a smallest distance L (described in detail later) to the first minute projection 20*c*, among the minute projections 20 present around the first minute projection 20*c*.

For each minute projection 20, one pitch P is determined. An average pitch Pav is calculated by summing the pitches P of all the minute projections 20 and dividing the sum of the pitches P by the number of the minute projections 20. The average pitch Pav is preferably not less than 10 μm. With the golf ball 2 in which the average pitch Pav is not less than 10 μm, the minute projections 20 do not excessively reduce lift force. With the golf ball 2, a large carry can be achieved. From this viewpoint, the average pitch Pav is more preferably not less than 20 μm and particularly preferably not less than 25 μm. The average pitch Pav is preferably not greater than 100 μm. With the golf ball 2 in which the average pitch Pav is not greater than 100 μm, the minute projections 20 reduce lift force and drag. With the golf ball 2, a large carry and a large run can be achieved. From this viewpoint, the average pitch Pay is more preferably not greater than 80 μm and particularly preferably not greater than 70 μm.

In FIG. 7, an arrow L indicates the distance between the first minute projection 20*c* and the second minute projection 20*d* adjacent to the first minute projection 20*c*. The distance L is a value obtained by subtracting the radius of the bottom surface 24*c* of the first minute projection 20*c* and the radius of the bottom surface 24*d* of the second minute projection 20*d* from the pitch P. For each minute projection 20, one distance L is determined. An average distance Lav is calculated by summing the distances L of all the minute projections 20 and dividing the sum of the distances L by the number of the minute projections 20. The average distance Lav is preferably not less than 5 μm and not greater than 50 μm. With the golf ball 2 in which the average distance Lav is not less than 5 μm, the minute projections 20 do not excessively reduce lift force. With the golf ball 2, a large carry can be achieved. From this viewpoint, the average distance Lav is more preferably not less than 10 μm and particularly preferably not less than 15 μm. With the golf ball 2 in which the average distance Lav is not greater than 50 μm, the minute projections 20 reduce lift force and drag. With the golf ball 2, a large carry and a large run can be achieved. From this viewpoint, the average distance Lav is more preferably not greater than 40 μm and particularly preferably not greater than 35 μm.

In FIG. 6, an arrow H indicates the height of the minute projection 20. The height H is measured along the radial direction of the golf ball 2. An average height Hav is calculated by summing the heights H of all the minute projections 20 and dividing the sum of the heights H by the number of the minute projections 20. The average height Hav is preferably not less than 0.5 μm and not greater than 50 μm. With the golf ball 2 in which the average height Hav is not less than 0.5 μm, the minute projections 20 reduce lift force and drag. With the golf ball 2, a large carry and a large run can be achieved. From this viewpoint, the average height Hav is more preferably not less than 2 μm and particularly preferably not less than 3 μm. With the golf ball 2 in which the average height Hav is not greater than 50 μm, the minute projections 20 do not excessively reduce lift force. With the golf ball 2, a large carry can be achieved. From this viewpoint, the average height Hav is more preferably not greater than 30 μm and particularly preferably not greater than 20 μm.

The total number of the minute projections 20 is preferably not less than 10 thousand and not greater than 10 million. With the golf ball 2 in which this total number is not less than 10 thousand, the minute projections 20 reduce lift force and drag. With the golf ball 2, a large carry and a large run can be achieved. From this viewpoint, this total number is more preferably not less than 20 thousand and particularly preferably not less than 50 thousand. With the golf ball 2 in which this total number is not greater than 10 million, the minute projections 20 do not excessively reduce lift force. With the golf ball 2, a large carry can be achieved. From this viewpoint, this total number is more preferably not greater than 7 million and particularly preferably not greater than 5 million.

As described above, each minute projection 20 includes the projection portion 22 of the main body 12 and the paint layer 10 (see FIG. 6). Therefore, even when the paint layer 10 is peeled from the main body 12 due to the golf ball 2 being hit by a golf club or colliding against the ground, the shapes of the minute projections 20 are substantially maintained. Accordingly, the aerodynamic characteristics are substantially maintained. A special paint is not needed for forming the minute projections 20. The golf ball 2 can be easily produced.

The paint layer 10 preferably has a thickness of not less than 5 μm and not greater than 30 μm. The paint layer 10 having a thickness of not less than 5 μm contributes to the appearance of the golf ball 2. From this viewpoint, this thickness is more preferably not less than 7 μm and particularly preferably not less than 8 μm. In the golf ball 2 that has the paint layer 10 having a thickness of not greater than 30 μm, the shape of each projection portion 22 is reflected in the shape of the minute projection 20. From this viewpoint, this thickness is more preferably not greater than 25 μm and particularly preferably not greater than 20 μm.

The paint layer 10 may contain powder (aggregates of particles) such as organic particles, inorganic particles, and a luminous material. The powder can contribute to the appearance of the golf ball 2. Furthermore, the powder increases the roughness of the surface of the golf ball 2. Therefore, the powder can also contribute to the aerodynamic characteristics of the golf ball 2. Preferably, the average particle diameter (median diameter D50) of the powder is not less than 1 μm and not greater than 15 μm. An example of organic particles is acrylic beads. Examples of inorganic particles include silica and talc.

Figure 8:
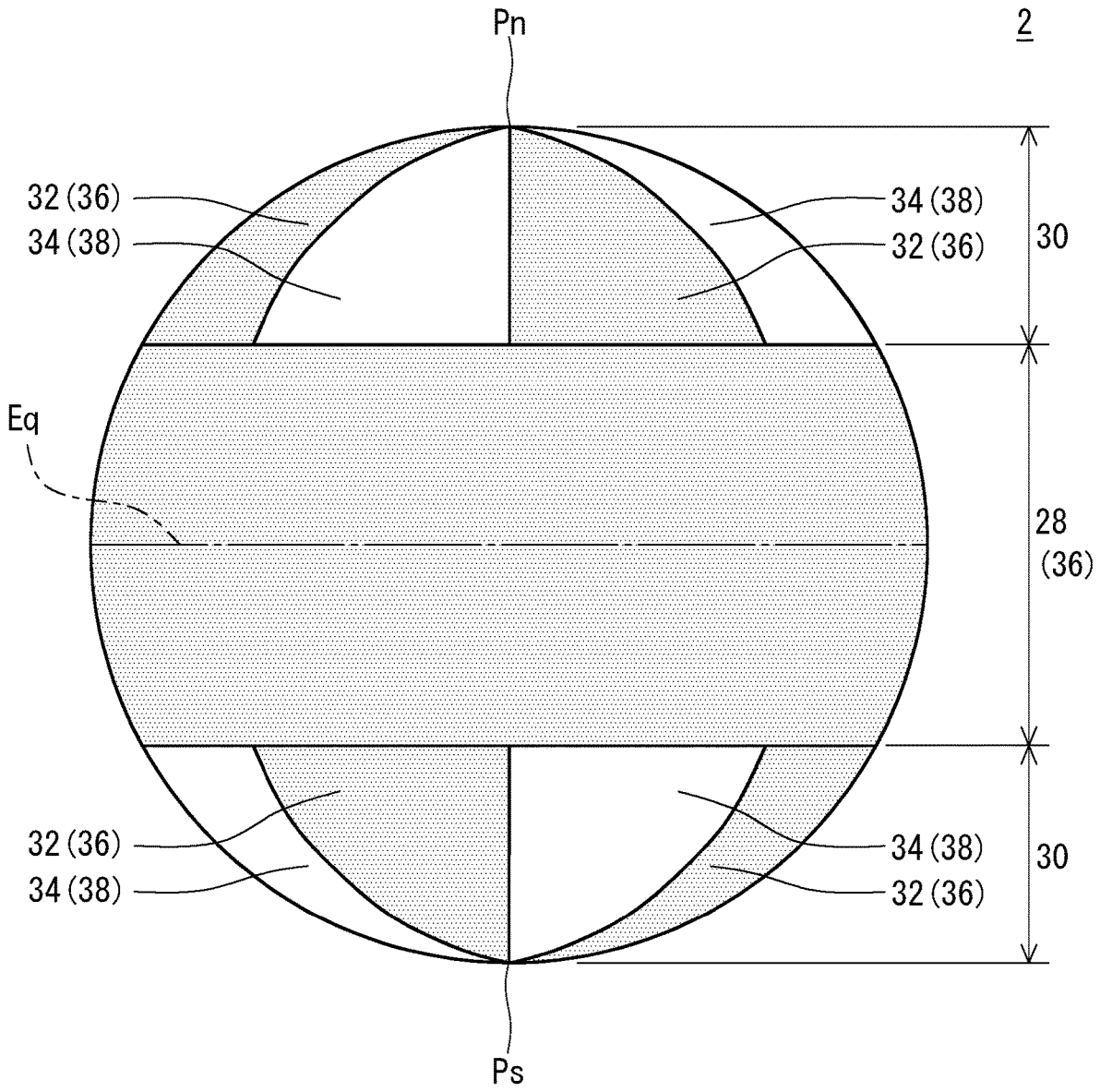
FIG. 8 is a schematic front view of the golf ball in FIG. 2.
Figure 9:
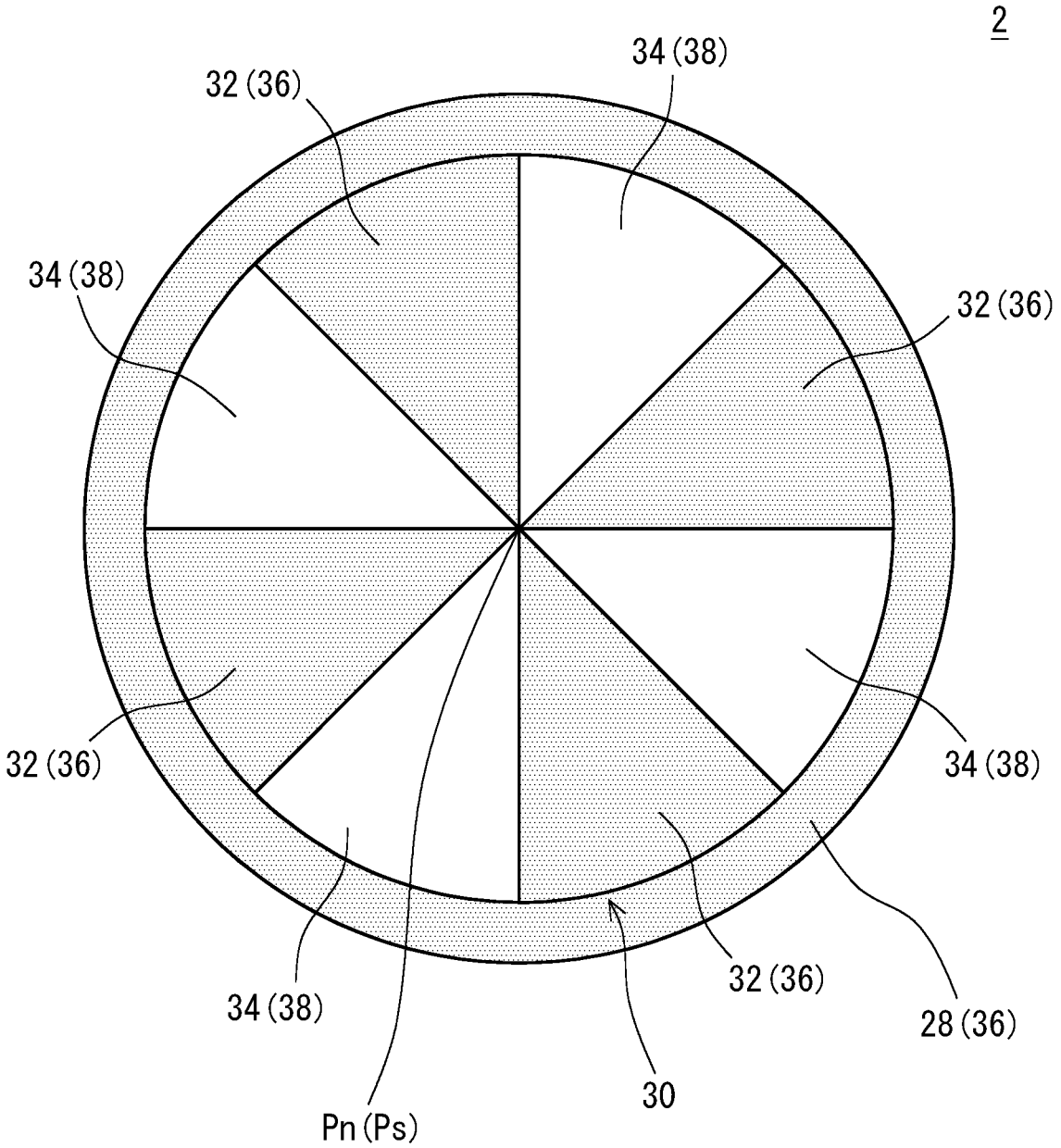
FIG. 9 is a schematic plan view of the golf ball in FIG. 3.

FIG. 8 is a front view of the golf ball 2 an FIG. 2, and FIG. 9 is a plan view of the golf ball 2. FIG. 9 is also a bottom view of the golf ball 2. For the sake of convenience of explanation of zones present on the surface of the golf ball 2, the golf ball 2 is schematically depicted in FIGS. 8 and 9. In FIGS. 8 and 9, the dimples 14 are not shown.

The golf ball 2 has one low-latitude portion 28 and two high-latitude portions 30. In FIGS. 8 and 9, for the convenience of explanation, the low-latitude portion 28 is filled with dots. Each high-latitude portion 30 has four first spherical triangles 32 and four second spherical triangles 34. In FIGS. 8 and 9, for the convenience of explanation, the first spherical triangles 32 are filled with dots. The second spherical triangles 34 are not filled. As shown in FIG. 9, these first spherical triangles 32 and these second spherical triangles 34 radially spread from the north pole Pn (or the south pole Ps) as a center. These first spherical triangles 32 and these second spherical triangles 34 are alternately arranged along the longitude direction. Since the golf ball 2 has two high-latitude portions 30, the total number of the first spherical triangles 32 is eight, and the total number of the second spherical triangles 34 is eight.

In the present embodiment, the low-latitude portion 28 is a first zone 36. Each first spherical triangle 32 is also a first zone 36. For the convenience of explanation, these first zones 36 are filled with dots. Meanwhile, each second spherical triangle 34 is a second zone 38. These second zones 38 are not filled.

The average value Hav1 of the heights H of all the minute projections 20 belonging to all the first zones 36 is higher than the average value Hav2 of the heights H of all the minute projections 20 belonging to all the second zones 38. On the surface of the golf ball 2, zones having a large average height Hav and zones having a small average height Hav coexist. The coexistence reduces the drag when the golf ball 2 is hit with a middle iron. The golf ball 2 has excellent flight performance upon a shot with a middle iron. Preferably, the average value of the heights H on each first zone 36 is higher than the average value of the heights H on any second zone 38.

Preferably, the average value Hav1 (μm) and the average value Hav2 (μm) satisfy the following mathematical formula.

$$3 \leq (Hav1 - Hav2) \leq 50$$

In other words, the difference (Hav1−Hav2) is preferably not less than 3 μm and not greater than 50 μm. With the golf ball 2, drag can be reduced. From this viewpoint, the difference (Hav1−Hav2) is more preferably not greater than 45 μm and particularly preferably not greater than 40 μm.

The average value Hav1 is preferably not less than 1 μm and not greater than 60 μm, and particularly preferably not less than 2 μm and not greater than 50 μm. The average value Hav2 is preferably not less than 0.0 μm and not greater than 55 μm, and particularly preferably not less than 1 μm and not greater than 50 μm. The second zone 38 in which the average value Hav2 is 0.0 μm does not have any minute projections 20.

The golf ball 2 preferably satisfies the following mathematical formula.

$$1 \leq (S1/S2) \leq 19$$

In this mathematical formula, S1 represents the ratio of the total area of all the first zones 36 to the surface area of the phantom sphere 18 of the golf ball 2. In this mathematical formula, S2 represents the ratio of the total area of all the second zones 38 to the surface area of the phantom sphere 18 of the golf ball 2. The area of each first zone 36 is the area of a portion, covered by the first zone 36, of the surface of the phantom sphere 18. The area of each second zone 38 is the area of the portion, covered by the second zone 38, of the surface of the phantom sphere 18.

With the golf ball 2 that satisfies the above mathematical formula, that is, the golf ball 2 in which the ratio (S1/S2) is not less than 1 and not greater than 19, the drag is reduced when the golf ball 2 is hit with a middle iron. The golf ball 2 has excellent flight performance upon a shot with a middle iron. In light of flight performance, the ratio (S1/S2) is more preferably not less than 2 and particularly preferably not less than 3. In light of flight performance, the ratio (S1/S2) is more preferably not greater than 15 and particularly preferably not greater than 13.

Each first zone 36 preferably has an arithmetic average height Sa1 of not less than 1.0 μm and not greater than 40 μm. With the golf ball 2 in which the arithmetic average height Sa1 is not less than 1.0 μm, the minute projections 20 reduce lift force and drag. With the golf ball 2, a large carry and a large run can be achieved. From this viewpoint, the arithmetic average height Sa1 is more preferably not less than 1.5 μm and particularly preferably not less than 2.0 μm. With the golf ball 2 in which the arithmetic average height Sa1 is not greater than 40 μm, the minute projections 20 do not excessively reduce lift force. With the golf ball 2, a large carry can be achieved. From this viewpoint, the arithmetic average height Sa1 is more preferably not greater than 30 μm and particularly preferably not greater than 20 μm.

Each second zone 38 preferably has an arithmetic average height Sa2 of not less than 0.3 μm and not greater than 30 μm. With the golf ball 2 in which the arithmetic average height Sa2 is not less than 0.3 μm, the minute projections 20 reduce lift force and drag. With the golf ball 2, a large carry and a large run can be achieved. From this viewpoint, the arithmetic average height Sa2 is more preferably not less than 0.5 μm and particularly preferably not less than 1.0 μm. With the golf ball 2 in which the arithmetic average height Sa2 is not greater than 30 μm, the minute projections 20 do not excessively reduce lift force. With the golf ball 2, a large carry can be achieved. From this viewpoint, the arithmetic average height Sa2 is more preferably not greater than 25 μm and particularly preferably not greater than 15 μm.

Preferably, the arithmetic average height Sa1 of each first zone 36 is larger than the arithmetic average height Sa2 of any second zone 38. In other words, the arithmetic average height Sa1 of the first zone 36 having the smallest arithmetic average height Sa1 is preferably larger than the arithmetic average height Sa2 of the second zone 38 having the largest arithmetic average height Sa2. The difference between the arithmetic average height Sa1 of the first zone 36 having the smallest arithmetic average height Sa1 and the arithmetic average height Sa2 of the second zone 38 having the largest arithmetic average height Sa2 is preferably not less than 0.5 μm, more preferably not less than 1.0 μm, and particularly preferably not less than 2.0 μm. This difference is preferably not greater than 20 μm.

Each first zone 36 preferably has a maximum height Sz1 of not less than 7 μm and not greater than 200 μm. With the golf ball 2 in which the maximum height Sz1 is not less than 7 μm, the minute projections 20 reduce lift force and drag. With the golf ball 2, a large carry and a large run can be achieved. From this viewpoint, the maximum height Sz1 is more preferably not less than 10 μm and particularly preferably not less than 20 μm. With the golf ball 2 in which the maximum height Sz1 is not greater than 200 μm, the minute projections 20 do not excessively reduce lift force. With the golf ball 2, a large carry can be achieved. From this viewpoint, the maximum height Sz1 is more preferably not greater than 150 μm and particularly preferably not greater than 100 μm.

Each second zone 38 preferably has a maximum height Sz2 of not less than 3 μm and not greater than 200 μm. With the golf ball 2 in which the maximum height Sz2 is not less than 3 μm, the minute projections 20 reduce lift force and drag. With the golf ball 2, a large carry and a large run can be achieved. From this viewpoint, the maximum height Sz2 is more preferably not less than 5 μm and particularly preferably not less than 10 μm. With the golf ball 2 in which the maximum height Sz2 is not greater than 200 μm, the minute projections 20 do not excessively reduce lift force. With the golf ball 2, a large carry can be achieved. From this viewpoint, the maximum height Sz2 is more preferably not greater than 150 μm and particularly preferably not greater than 100 μm.

Preferably, the maximum height Sz1 of each first zone 36 is larger than the maximum height Sz2 of any second zone 38. In other words, the maximum height Sz1 of the first zone 36 having the smallest maximum height Sz1 is preferably larger than the maximum height Sz2 of the second zone 38 having the largest maximum height Sz2. The difference between the maximum height Sz1 of the first zone 36 having the smallest maximum height Sz1 and the maximum height Sz2 of the second zone 38 having the largest maximum height Sz2 is preferably not less than 0.5 μm, more preferably not less than 1.0 μm, and particularly preferably not less than 2.0 μm. This difference is preferably not greater than 20 μm.

The arithmetic average heights Sa1 and Sa2 and the maximum heights Sz1 and Sz2 are measured according to the standards of ISO-25178 with a laser microscope (for example, a non-contact type surface roughness/shape measuring instrument of Keyence Corporation). In the microscope, the surface of the golf ball 2 is scanned with a laser in an X direction and a Y direction. Through this scanning, unevenness data of the surface of the golf ball 2 is obtained. The arithmetic average heights and the maximum heights are calculated on the basis of a three-dimensional image obtained from the unevenness data. The measurement conditions are as follows.

Magnification: 1000
Measurement range X: 250 μm
Measurement range Y: 250 μm
Cutoff value: λc=0.25
Observation region: X=1024 pixels, Y=768 pixels
Total number of pixels: 786432 pixels For producing the golf ball 2, known molding methods can be used. Typical methods are compression molding and injection molding. In each of the methods, a mold having a plurality of pimples and a plurality of minute recesses on a cavity face thereof is used. The cover 8 is formed from materials introduced into the mold. The minute projection portions 22 having a shape that is the inverted shape of the minute recesses are formed on the cover 8. A paint is applied to the surface of the cover 8, and a plurality of minute projections 20 having a shape in which the surface shape of the cover 8 is reflected are formed.

In this production method, the shapes of the minute projections 20 can be controlled in the design of the mold. The intention of the designer can be reflected in the arrangement of the minute projections 20 of the golf ball 2 obtained by this production method. In the golf ball 2 obtained by this production method, a large number of the minute projections 20 can be regularly or orderly arranged.

After the cover 8 is formed, the specifications of the minute projections 20 may be adjusted by polishing the surface of the cover 8. The second zones 38 may be formed by selectively polishing parts of the surface of the cover 8.

A polyhedron may be used for arranging the first zones 36 and the second zones 38. The surface of the phantom sphere 18 is divided into a plurality of spherical polygons by comparting lines obtained by projecting the edge lines of a polyhedron, which is inscribed in the phantom sphere 18, onto the surface of the phantom sphere 18. A first zone 36 or a second zone 38 is assigned to each of the spherical polygons. Examples of preferable polyhedrons include regular polyhedrons and semi-regular polyhedrons. Examples of regular polyhedrons include a regular octahedron, a regular dodecahedron, and a regular icosahedron. Examples of semi-regular polyhedrons include a cuboctahedron and a dodecicosahedron. The surface of the phantom sphere 18 may be divided by a geodesic polyhedron.

Each dimple 14 may be formed as a first zone 36, and the land 16 may be formed as a second zone 38. Alternatively, each dimple 14 may be formed as a second zone 38, and the land 16 may be formed as a first zone 36.

The arrangement method for the first zones 36 and the second zones 38 is not limited to the above-described method. Any arrangement method can be used. The golf ball 2 may have zones that are not the first zones 36 and are not the second zones 38.

Figure 10:
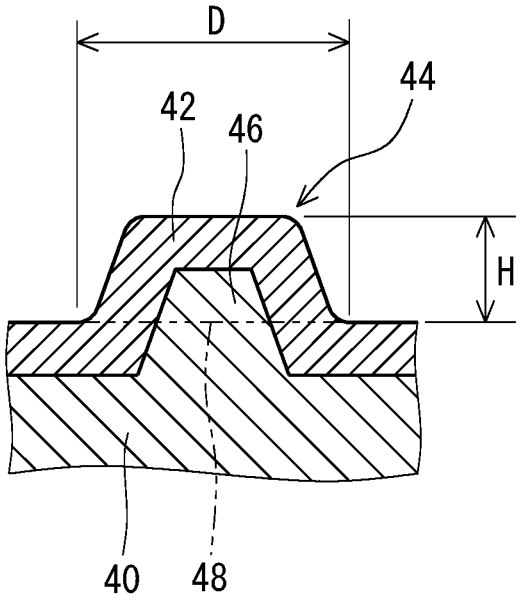
FIG. 10 is a cross-sectional view of a part of a golf ball according to another embodiment of the present invention.

FIG. 10 is a cross-sectional view of a part of a golf ball according to another embodiment of the present invention. FIG. 10 shows a cover 40 that is a part of a main body, and a paint layer 42. FIG. 10 also shows a minute projection 44. The cover 40 has projection portions 46. The minute projection 44 is formed by the projection portion 46 and the paint layer 42. Each projection portion 46 is covered with the paint layer 42. The projection portion 46 stands outward in the radial direction of the golf ball (the upward direction in FIG. 10). Thus, the minute projection 44 also stands outward in the radial direction of the golf ball. In other words, the minute projection 44 has a shape in which the surface shape of the main body (the cover 40) is reflected. In FIG. 10, reference character 48 indicates the bottom surface of the minute projection 44.

The projection portion 46 has a truncated cone shape. Therefore, the minute projection 44 also has a truncated cone shape. The specifications of this golf ball excluding the shape of the projection portion 46 and the shape of the minute projection 44 are the same as the specifications of the golf ball 2 shown in FIGS. 1 to 9. This golf ball also has first zones 36 and second zones 38 as shown in FIGS. 8 and 9.

With this golf ball as well, the minute projections 44 contribute to a flight distance upon a shot with a middle iron. With this golf ball as well, the paint layer 42 is less likely to be peeled from the main body (the cover 40). With this golf ball as well, coexistence of the first zones 36 and the second zones 38 contributes to aerodynamic characteristics.

The golf ball may have minute projections having a shape such as a cone shape, a prism shape, a truncated pyramid shape, a pyramid shape, a partial sphere shape, and the like.

EXAMPLES

Example 1

A rubber composition was obtained by kneading 100 parts by weight of a high-cis polybutadiene (trade name "BR-730", manufactured by JSR Corporation), 27.4 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 160° C. for 20 minutes to obtain a core with a diameter of 38.20 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "TEFABLOC T3221C", manufactured by Mitsubishi Chemical Corporation), 4 parts by weight of titanium dioxide (A220), and 0.2 parts by weight of a light stabilizer (trade name "JF-90", manufactured by Johoku Chemical Co., Ltd.) with a twin-screw kneading extruder. The core was covered with this resin composition by injection molding to form a mid layer. The thickness of the mid layer was 1.00 mm.

A resin composition was obtained by kneading 47 parts by weight of an ionomer resin (trade name "Himilan 1555", manufactured by Du Pont-MITSUI POLYCHEMICALS Co., Ltd.), 46 parts by weight of another ionomer resin (trade name "Himilan 1557", manufactured by Du Pont-MITSUI POLYCHEMICALS Co., Ltd.), 7 parts by weight of a styrene block-containing thermoplastic elastomer (the aforementioned "TEFABLOC T3221C"), 4 parts by weight of titanium dioxide (A220), and 0.2 parts by weight of a light stabilizer (the aforementioned "JF-90") with a twin-screw kneading extruder. The sphere consisting of the core and the mid layer was placed into a final mold having a large number of pimples and minute recesses on its cavity face. The mid layer was covered with the resin composition by injection molding to form a cover. The thickness of the cover was 1.25 mm. Dimples having a shape that is the inverted shape of the pimples were formed on the cover. Furthermore, minute projection portions having a shape that is the inverted shape of the minute recesses were formed on the cover.

A clear paint including a two-component curing type polyurethane as a base material was applied to this cover to obtain a golf ball of Example 1 with a diameter of about 42.7 mm and a weight of about 45.6 g. The golf ball has a large number of dimples and minute projections on the surface thereof. The specifications of these minute projections are shown in Table 1 below. These minute projections each have a columnar shape (see FIGS. 6 and 7). The golf ball has first zones and second zones on the surface thereof (see FIGS. 8 and 9).

Examples 2 to 11 and Comparative Examples 1 to 3

Golf balls of Examples 2 to 11 and Comparative Examples 1 to 3 were obtained in the same manner as Example 1, except the final mold was changed and minute projections having specifications shown in Tables 1 to 4 below were formed. The second zone of the golf ball according to Example 5 does not have any minute projections. In the golf ball according to Comparative Example 1, the minute projections are uniformly arranged on the surface thereof.

Example 12

A golf ball of Example 12 was obtained in the same manner as Example 1, except a paint layer containing silica having an average particle diameter of 2 μm was provided. The amount of silica in the paint layer was 30 parts by weight per 100 parts by weight of the resin component.

Comparative Example 4

A golf ball of Comparative Example 4 was obtained in the same manner as Example 1, except the final mold was changed and dimples having specifications shown in Table 4 below were formed. The golf ball does not have any minute projections.

[Flight Test]

An iron club #7 (trade name "XXIO 10", manufactured by Sumitomo Rubber Industries, Ltd., shaft hardness: R) was attached to a swing machine manufactured by Golf Laboratories, Inc. A golf ball was hit under a condition of a head speed of 33 m/sec, and the carry and the run were measured. The flight distance was calculated on the basis of the carry and the run. During the test, the weather was almost windless. The landing point was on flat lawn. The average value of data obtained by 20 measurements is shown in Tables 1 to 4 below.

TABLE 1

Results of Evaluation

| | Compa. Example 1 | Compa. Example 2 | Example 2 | Example 1 |
|---|---|---|---|---|
| Silica | None | None | None | None |
| Front view | FIG. 2 | FIG. 2 | FIG. 2 | FIG. 2 |
| Plan view | FIG. 3 | FIG. 3 | FIG. 3 | FIG. 3 |
| Number of dimples | 338 | 338 | 338 | 338 |
| First zone | | | | |
| Dav1 (μm) | 15 | 15 | 15 | 15 |
| Pav1 (μm) | 37.5 | 37.5 | 37.5 | 37.5 |
| Pp1 (%) | 14.5% | 14.5% | 14.5% | 14.5% |
| Hav1 (μm) | 5 | 0.5 | 5 | 5 |
| S1 | 1.00 | 0.82 | 0.82 | 0.82 |
| Second zone | | | | |
| Dav2 (μm) | — | 15 | 15 | 15 |
| Pav2 (μm) | — | 37.5 | 37.5 | 37.5 |
| Pp2 (%) | — | 14.5% | 14.5% | 14.5% |
| Hav2 (μm) | — | 0.2 | 3 | 2 |
| S2 | — | 0.18 | 0.18 | 0.18 |
| S1/S2 | — | 4.56 | 4.56 | 4.56 |
| Hav1 − Hav 2 | — | 0.3 | 2.0 | 3.0 |
| Hav (μm) | 5.0 | 0.4 | 4.6 | 4.5 |
| Flight distance (m) | 136.7 | 136.9 | 137.9 | 138.9 |

Dav1: the average value of the diameters D of the minute projections in the first zone.
Pav1: the average value of the pitches P of the minute projections in the first zone.
Pp1: the area percentage of the minute projections in the first zone.
Dav2: the average value of the diameters D of the minute projections in the second zone.
Pav2: the average value of the pitches P of the minute projections in the second zone.
Pp2: the area percentage of the minute projections in the second zone.

TABLE 2

Results of Evaluation

| | Example 3 | Example 4 | Example 5 | Example 6 |
|---|---|---|---|---|
| Silica | None | None | None | None |
| Front view | FIG. 2 | FIG. 2 | FIG. 2 | FIG. 2 |
| Plan view | FIG. 3 | FIG. 3 | FIG. 3 | FIG. 3 |
| Number of dimples | 338 | 338 | 338 | 338 |
| First zone | | | | |
| Dav1 (μm) | 25 | 25 | 15 | 15 |
| Pav1 (μm) | 50 | 50 | 37.5 | 37.5 |
| Pp1 (%) | 22.7% | 22.7% | 14.5% | 14.5% |
| Hav1 (μm) | 5 | 5 | 3 | 12 |
| S1 | 0.82 | 0.82 | 0.82 | 0.82 |
| Second zone | | | | |
| Dav2 (μm) | 25 | 15 | — | 15 |
| Pav2 (μm) | 50 | 37.5 | — | 37.5 |
| Pp2 (%) | 22.7% | 14.5% | — | 14.5% |
| Hav2 (μm) | 2 | 2 | 0 | 2 |
| S2 | 0.18 | 0.18 | 0.18 | 0.18 |
| S1/S2 | 4.56 | 4.56 | 4.56 | 4.56 |
| Hav1 − Hav2 | 3.0 | 3.0 | 3.0 | 10.0 |
| Hav (μm) | 4.5 | 4.5 | 2.5 | 10.2 |
| Flight distance (m) | 138.7 | 138.5 | 138.4 | 138.8 |

TABLE 3

Figure 11:
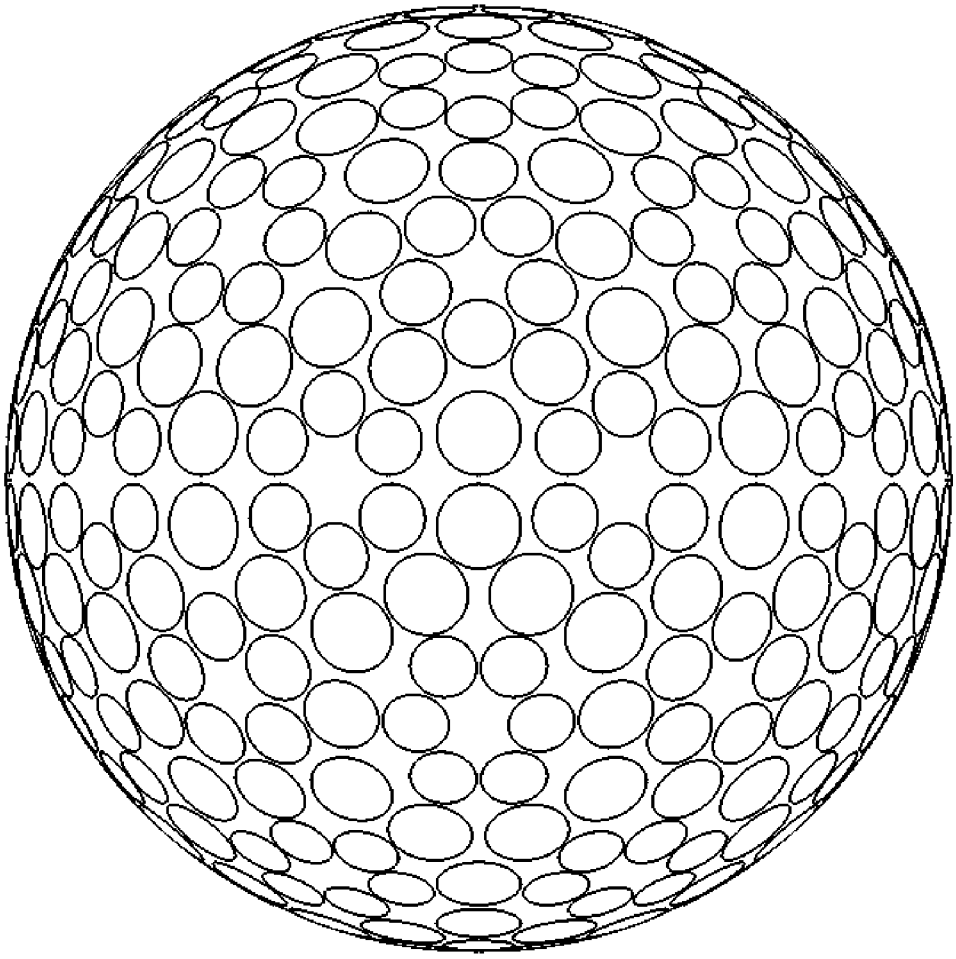
FIG. 11 is a front view of a golf ball according to Example 8 of the present invention.
Figure 12:
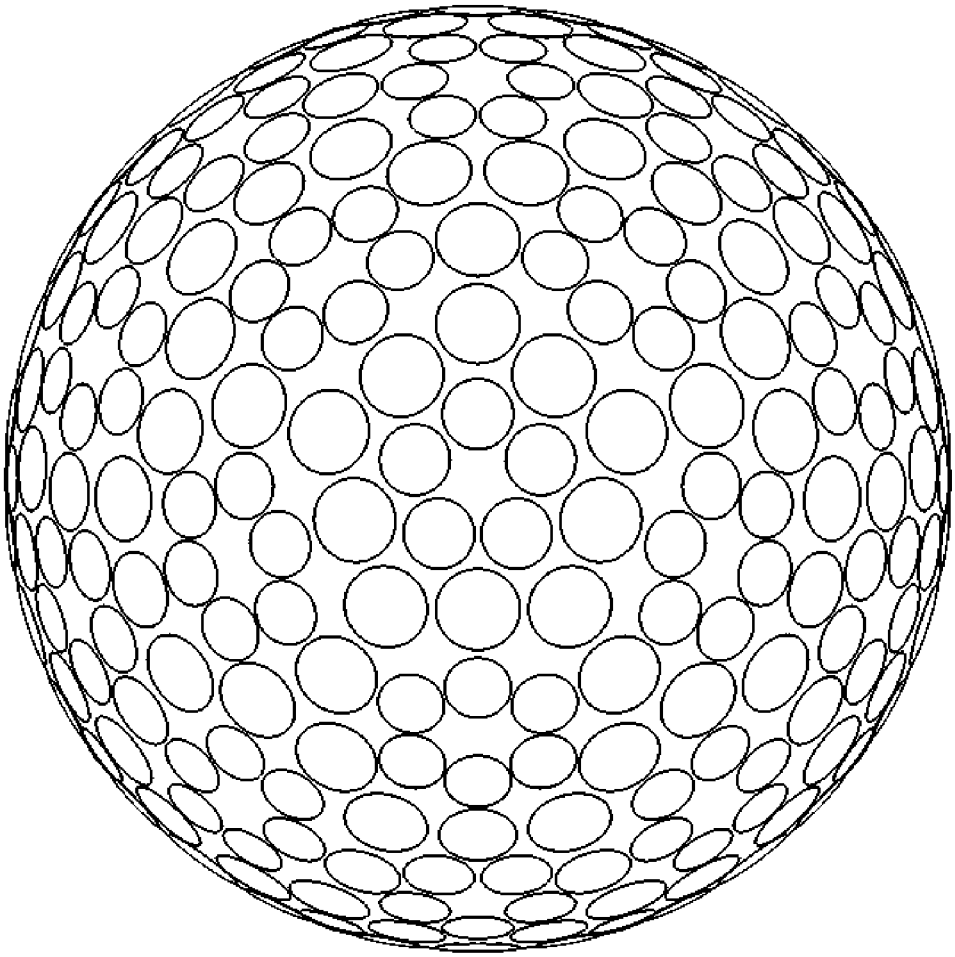
FIG. 12 is a plan view of the golf ball in FIG. 11.

| Results of Evaluation | | | | |
|---|---|---|---|---|
| | Compa. Example 3 | Example 7 | Example 8 | Example 9 |
| Silica | None | None | None | None |
| Front view | FIG. 2 | FIG. 2 | FIG. 11 | FIG. 11 |
| Plan view | FIG. 3 | FIG. 3 | FIG. 12 | FIG. 12 |
| Number of dimples | 338 | 338 | 420 | 420 |
| First zone | | | | |
| Dav1 (μm) | 15 | 15 | 15 | 15 |
| Pav1 (μm) | 37.5 | 37.5 | 37.5 | 37.5 |
| Pp1 (%) | 14.5% | 14.5% | 14.5% | 14.5% |
| Hav1 (μm) | 60 | 5 | 5 | 5 |
| S1 | 0.82 | 0.18 | 0.35 | 0.65 |
| Second zone | | | | |
| Dav2 (μm) | 15 | 15 | 15 | 15 |
| Pav2 (μm) | 37.5 | 37.5 | 37.5 | 37.5 |
| Pp2 (%) | 14.5% | 14.5% | 14.5% | 14.5% |
| Hav2 (μm) | 20 | 2 | 2 | 2 |
| S2 | 0.18 | 0.82 | 0.65 | 0.35 |
| S1/S2 | 4.56 | 0.22 | 0.54 | 1.86 |
| Hav1 − Hav2 | 40.0 | 3.0 | 3.0 | 3.0 |
| Hav (μm) | 52.8 | 2.5 | 3.1 | 4.0 |
| Flight distance (m) | 137.0 | 137.3 | 137.7 | 138.3 |

TABLE 4

| Results of Evaluation | | | | |
|---|---|---|---|---|
| | Example 10 | Example 11 | Example 12 | Compa. Example 4 |
| Silica | None | None | Contained | None |
| Front view | FIG. 2 | FIG. 2 | FIG. 2 | FIG. 2 |
| Plan view | FIG. 3 | FIG. 3 | FIG. 3 | FIG. 3 |
| Number of dimples | 338 | 338 | 338 | 338 |
| First zone | | | | |
| Dav1 (μm) | 15 | 15 | 15 | — |
| Pav1 (μm) | 37.5 | 37.5 | 37.5 | — |
| Pp1 (%) | 14.5% | 14.5% | 14.5% | — |
| Hav1 (μm) | 5 | 5 | 5 | — |
| S1 | 0.95 | 0.96 | 0.82 | — |
| Second zone | | | | |
| Dav2 (μm) | 15 | 15 | 15 | — |
| Pav2 (μm) | 37.5 | 37.5 | 37.5 | — |
| Pp2 (μm) | 14.5% | 14.5% | 14.5% | — |
| Hav2 (μm) | 2 | 2 | 2 | — |
| S2 | 0.05 | 0.04 | 0.18 | — |
| S1/S2 | 19.00 | 24.00 | 4.56 | — |
| Hav1 − Hav2 | 3.0 | 3.0 | 3.0 | — |
| Hav (μm) | 4.9 | 4.9 | 4.5 | — |
| Flight distance (m) | 138.0 | 137.4 | 139.2 | 136.5 |

As shown in Tables 1 to 4, the golf ball of each Example has excellent flight performance upon a shot with a middle iron. From the evaluation results, advantages of the present invention are clear.

The aforementioned minute projections are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball comprising a main body and a paint layer positioned outside the main body, wherein the golf ball has, on a surface thereof, a plurality of minute projections, an average diameter Dav of the minute projections is not less than 5 μm and not greater than 50 μm, an average value Hav of heights H of the minute projections is not less than 0.5 μm and not greater than 50 μm, the surface of the golf ball has one or more first zones and one or more second zones, and an average value Hav1 of the heights H of the minute projections on the first zones is higher than an average value Hav2 of the heights H of the minute projections on the second zones.

2. The golf ball according to claim 1, wherein a ratio S1 of a total area of the first zones to a surface area of a phantom sphere of the golf ball and a ratio S2 of a total area of the second zones to the surface area of the phantom sphere of the golf ball satisfy the following mathematical formula, $$1 \leq (S1/S2) \leq 19.$$

3. The golf ball according to claim 1, wherein the average value Hav1 and the average value Hav2 satisfy the following mathematical formula, $$3 \leq (Hav1 - Hav2) \leq 50.$$

4. The golf ball according to claim 1, wherein an arithmetic average height Sa1 of each first zone is larger than an arithmetic average height Sa2 of any second zone, wherein the arithmetic average heights Sa1 and Sa2 are based on a three-dimensional image obtained from a laser microscope scanning of the golf ball surface to generate unevenness data and corresponds to the average height of the surface of the golf ball as measured according to the standards of ISO-25178.

5. The golf ball according to claim 1, wherein a maximum height Sz1 of the minute projections of each first zone is larger than a maximum height Sz2 of the minute projections of any second zone.

6. The golf ball according to claim 1, wherein the paint layer has a thickness of not less than 5 μm and not greater than 30 μm.

7. The golf ball according to claim 1, wherein the paint layer contains a base polymer and particles dispersed in the base polymer, and the particles have an average particle diameter of not less than 1 μm and not greater than 15 μm.

8. A method for producing the golf ball according to claim 1, the method comprising the steps of:

introducing a material of a cover into a mold having a plurality of minute recesses on a cavity face thereof;

forming the cover having minute projection portions having a shape that is an inverted shape of the minute recesses, from the material; and applying a paint to a surface of the cover to form a plurality of minute projections that correspond to the minute projection portions.

9. The golf ball according to claim 1, wherein an average pitch Pav of the minute projections is not less than 10 μm and not greater than 100 μm.

10. The golf ball according to claim 1, wherein a total number of the minute projections is not less than 10 thousand and not greater than 10 million.

11. The golf ball according to claim 4, wherein the arithmetic average heights Sa1 and Sa2 are each within a range of 0.3 μm to 30 μm.

* * * * *